United States Patent [19]

Garton

[11] Patent Number: 4,498,556

[45] Date of Patent: Feb. 12, 1985

[54] VERTICALLY MOVABLE, ROAD TOWABLE WORK PLATFORM

[75] Inventor: John W. Garton, Purston, nr. Pontefract, England

[73] Assignee: Access Engineering Ltd., England

[21] Appl. No.: 466,501

[22] Filed: Feb. 15, 1983

[30] Foreign Application Priority Data

Sep. 11, 1982 [GB] United Kingdom ..... 8225960

[51] Int. Cl.[3] ..... E04G 1/18

[52] U.S. Cl. ..... 182/19; 182/63; 182/148

[58] Field of Search ..... 182/63, 36, 148, 112, 182/18, 19, 1; 187/9 E, 11

[56] References Cited

U.S. PATENT DOCUMENTS

| | | | |
|---|---|---|---|
| 1,699,544 | 1/1929 | Rohlfing | 182/14 |
| 2,661,082 | 12/1953 | Ziegler | 189/14 |
| 2,970,523 | 2/1961 | Schurger | 182/148 |
| 3,016,973 | 1/1962 | Williamson | 182/63 |
| 3,516,512 | 6/1970 | Kupke | 182/63 |
| 3,684.056 | 8/1972 | Penso | 182/19 |
| 3,752,263 | 8/1973 | Thevenot | 182/148 |
| 3,814,211 | 6/1974 | Pamer | 182/19 |
| 3,854,418 | 12/1974 | Bertin | 105/29 R |
| 3,874,477 | 4/1975 | Hedstrom | 182/141 |
| 3,927,732 | 12/1975 | Ooka | 182/63 |
| 3,937,301 | 2/1976 | Bertail | 182/63 |
| 4,068,737 | 1/1978 | Lenz | 182/63 |
| 4,293,054 | 10/1981 | Pieri | 182/63 |

*Primary Examiner*—Reinaldo P. Machado
*Assistant Examiner*—Alvin Chin-Shue
*Attorney, Agent, or Firm*—Kenway & Jenney

[57] ABSTRACT

A road towable platform having a sectional mast for rapid erection at the face of a structure for the performance of work thereon. The platform is vertically driven on the mast by means of dual independent drives each comprising a motor, a centrifugal overspeed brake, a triple reduction spur gear train, and a pinion engaging an independent rack on the mast. Each motor also has an integral disc brake engaged when the power is off.

7 Claims, 2 Drawing Figures

VERTICALLY MOVABLE, ROAD TOWABLE WORK PLATFORM

SUMMARY OF THE INVENTION

This invention relates generally to work platforms of the type used to deliver workers and materials to positions on the faces of structures such as buildings, for the purpose of performing work such as pointing, painting, cladding, brick laying, window cleaning and various installation and maintenance operations. More particularly, the invention is directed to work platforms for short-term use where it is desired to achieve economy in erection without sacrifice in reliability, efficiency and worker safety.

Many of the prior art structures for the support of vertically movable work platforms are costly and time-consuming to erect and dismantle. This applies, for example, to tubular metal scaffolds that are erected in sections, which have the further disadvantage that in use they provide obstacles preventing free access to the working area. This also applies to platforms such as exterior elevators that are raised and lowered by means of counterbalances.

It has been previously proposed to provide work platforms that are supported by and vertically movable on sectional masts. A mast, in addition to providing means for supporting and stabilizing a work platform, is provided with means drivingly engageable with the platform. Although such structures would seem to offer economies in erection, their use has been restricted by considerations of safety as well as the cost of transporting the structure to the site.

With a view to overcoming the above and other disadvantages associated with the use of sectional masts, this invention provides a road towable structure including a chassis, a bottom mast section permanently secured to the chassis, and a work platform mounted for vertical movement on the mast section. This assembly of the primary components is readily transportable over the road, being carried on either a trailer or a self-propelled vehicle.

The bottom mast section is readily and quickly extendable to the required working height on the site by the addition of further mast sections with the aid of a permanently mounted crane. The crane is also useful for raising and lowering work materials and equipment.

The chassis is provided with adjustable stabilizers that permit the mast to be extended to ten meters as a free-standing structure supporting, for example, a work platform of six meters length. For extending to heights as great as 100 meters, the mast is conveniently tied to the structure at eight-meter intervals above the ten-meter height.

A feature of primary importance to the safety of the invention resides in the dual vertical drive system. The mast sections are each provided with two parallel vertically extending racks, and the platform is provided with a driven pinion for engagement with each of the racks. Each pinion has a separate and independent drive that includes a motor having an integral disc brake engaged when the power is off, a centrifugal overspeed brake operative to limit the rate of descent of the platform, and a triple reduction spur gear train driving the pinion. Each of the drives is capable of raising and lowering the platform independently of the other drive, but both drives are normally operated in unison. Thus the vertical drive system is provided with important fail-safe features.

Further safety features of the platform include a safety cage having access gates fitted with electrical trip switches preventing vertical movement of the platform when a gate is open. Independent safety switches are also provided to prevent the platform from being raised above its safe limit position relative to the top mast section in use. Further safety features are included, as described below, to prevent failure of proper operation under a variety of potential abnormal conditions.

DETAILED DESCRIPTION

Figure 1:
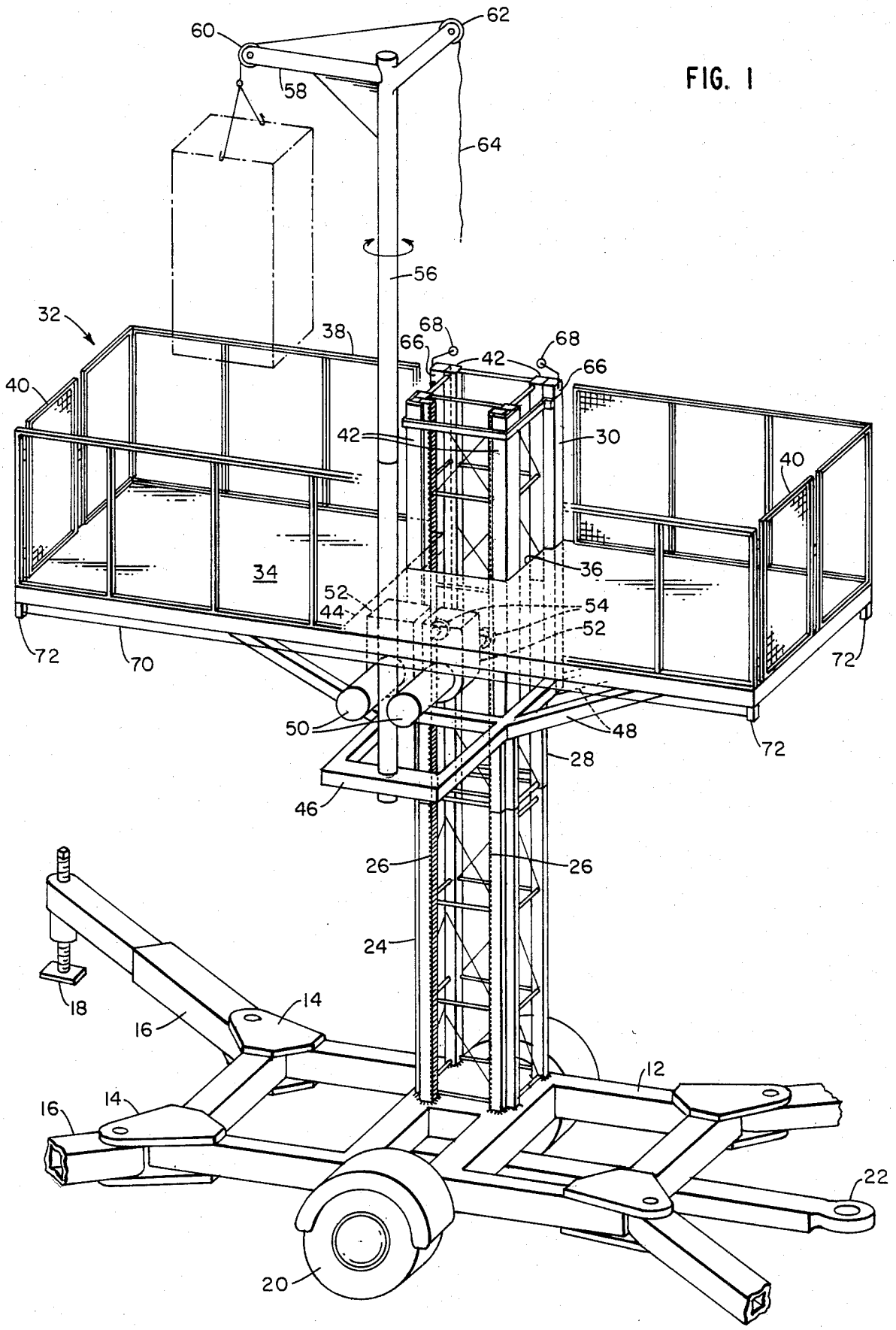
FIG. 1 illustrates a preferred embodiment of the invention as incorporated in a road towable single-axle trailer.

Referring to FIG. 1, the work platform is supported on a rigid steel chassis 12 comprising a reinforced frame with corner gusset plates 14 pivotally supporting for telescoping tubular stabilizers 16. Each stabilizer has a vertically adjustable foot 18 for leveling. The chassis supports an axle for road wheels 20 and is provided with a suitable hitch 22.

A bottom mast section 24 is permanently welded to the chassis 12. This section is a rigid frame of substantially square cross-section comprising steel angle members with connecting cross and diagonal braces. On one side there are permanently secured a pair of parallel steel racks 26. Load bearing jacks (not shown) are placed directly under the section 24 in use. The top of the section 24 is suitably provided with bolt holes for attachment of another mast section 28 at the work site. In the drawing, a third section 30 is shown similarly attached to the section 28.

A work platform generally designated at 32 is assembled and initially located at its lowermost position on the bottom mast section 24 for over-the-road transport to the work site. The additional sections 28 and 30, as well as other sections that may be used at the site, are separately transported in any convenient manner.

The work platform 32 comprises a flat, rigid working base 34 having an open-sided aperture 36 for clearance around the mast sections on three sides thereof. A safety cage 38 surrounds the base 34 and has hinged gates 40 for access.

The work platform has a supporting structure comprising four vertical members 42 extending above and below the base 34, a pair of horizontal frames 44 and 46 holding the vertical members 42 in sliding contact with three sides of the mast, and struts 48 extending from the lower frame 46 to the base 34.

Within this supporting structure there are mounted a pair of mutually independent drives, one for engagement with each of the racks 26. The drives include a pair of three-phase electrical motors 50 each having an integral disc brake of the type that engages when the power to the motor is off and disengages when the power is on. The motors are respectively geared to independent triple reduction spur-gear trains 52, and these gear trains have respective pinions 54 engaging the respective racks 26.

Each of the spur-gear trains 52 is connected to one of the motors 50 by a pair of centrifugal over-speed brakes, shown as integral with the gear trains 52. These brakes are adapted to operate when the speed of the pinions 54 is approximately 10% higher than the normal driving speed which is achieved when the platform is being raised or lowered under electrical power supplied to the motors 50. Thus for example, if the normal vertical speed is 7.5 meters per minute, the over-speed brakes would operate to prevent the platform from descending at over 8.25 meters per minute. At this maximum rate of descent, the platform can be protected against damage by buffer springs or bumpers suitably mounted on the chassis (not shown).

Each of the motors 50 and its associated drive train has sufficient power for raising and lowering the platform on the mast at normal speed; however, the electrical circuits are connected to operate the motors in parallel under normal working conditions.

A crane mast 56 is pivotally supported on the platform 32 and has a crane arm 58 and pulleys 60 and 62 for a hoisting rope 64. The crane may be swung outboard or inboard of the platform to facilitate the hoisting of additional mast sections, work materials such as brick pallets, or tools and equipment. This crane system may be fitted with a motor for hauling the rope 64, if desired. Preferably, there is also a limit switch connected so that the motors 50 cannot be energized unless the crane is in a safe "parking" position.

The electrical system for energizing the motors 50 preferably includes a hand-held controller (not shown) attached by a cable pendent from the platform so that the controller may be used by a person on the platform or by a person standing at ground level. The controller preferably includes an emergency stop and loop button, a "power on" button, and "raise" and "lower" buttons both of the dead-man type. The controller unit is preferably of waterproof construction.

Safety switches 66 are provided to ensure that the platform is not raised above a safe height relative to the topmost mast section in use. Each switch includes a spring-loaded roller 68 engaging the face of a mast leg. If the operator takes the platform up to a predetermined height, as illustrated in the drawing, the roller will pass off the mast leg and activate the switch 66, which will deenergize the motors 50.

If desired, secondary safety switches of the proximity-type (not shown) may supplement the switches 66. These proximity switches may be mounted a few inches below the switches 66 in a suitable manner, providing a redundant safety feature.

Switches similar to the switches 66 (not shown) are also provided to limit the downward movement of the platform on the bottom mast section 24.

The structure as described is sufficiently rigid for a free-standing platform height of ten meters above ground level. If a mast of greater height is required for the particular structure, suitable tie members (not shown) are connected between the mast sections and the structure at approximately the ten-meter level and at intervals of eight meters above the level. It will be evident that such ties do not interfere with the vertical movement of the platform or the access of the workers on the platform to the contiguous surfaces of the structure. In this manner the mast may be extended to a total height of as much as 100 meters.

The process of erection and disassembly of the work platform will be substantially evident from the preceding description and the drawing. For the purposes of either attaching or dismantling a topmost mast section from the section beneath, it, the platform is moved to a suitable height permitting a worker thereon to fit on or remove the bolts connecting the sections together. The work is accomplished with the worker standing safely within the cage 32.

Preferably, the access gates 40 are provided with safety switches (not shown) that are connected to the circuits energizing the motor 50. Thus, if the gates 40 are not securely closed, the motors cannot be energized.

It has been found that in practice, all of the operations including road transport, erection and dismantling of the work platform can be accomplished by two workers. Thus a substantial reduction in road transport as well as erection costs can be achieved.

With its safe working load of 1.5 tons, the above-described platform can deliver sufficient materials and the necessary workforce to the working height in a very few minutes after arrival at the site,—for example a pallet of bricks, mortar and two workers,—allowing for considerable continuity of work without returning to the ground or requiring extra equipment to transport the materials.

The electrical circuits preferably include reversing contactors and a changeover switch so that the direction of rotation of the motors 50 when the "raise" and "lower" buttons are depressed will be correct regardless of the phase connections that are made to the source of electrical power.

The invention is adapted for the inclusion of safety features in addition to those described above. For example, one or more safety pull wires 70 may be stretched along and beneath the platform 32 and attached to switches 72 connected in the energizing circuit for the motors 50. If a pull wire 70 is deflected either intentionally by an operator or by engagement with any obstruction, the operation of any of the switches 72 will deenergize the motors 50 and bring the platform to a stop.

An earth monitoring system can be incorporated to ensure that the platform is electrically connected to the earth at all times. This can be accomplished by conventional circuitry, whereby a failure of the earth connection to the platform will cause a main electrical contactor supplying power to the motors 50 and other circuits on the platform to be disconnected.

Each of the motors 50 is also provided with an overload disconnect circuit of a conventional type.

Audible alarm and flashing beacon devices may be fitted under the platform and arranged to sound and flash whenever the platform is in motion.

Suitable grounded power take-off sockets (not shown) are provided on the platform for connection of hand tools.

An earth-leakage circuit breaker may be incorporated in the energizing circuit for the motors 50 for additional electrical protection.

Figure 2:
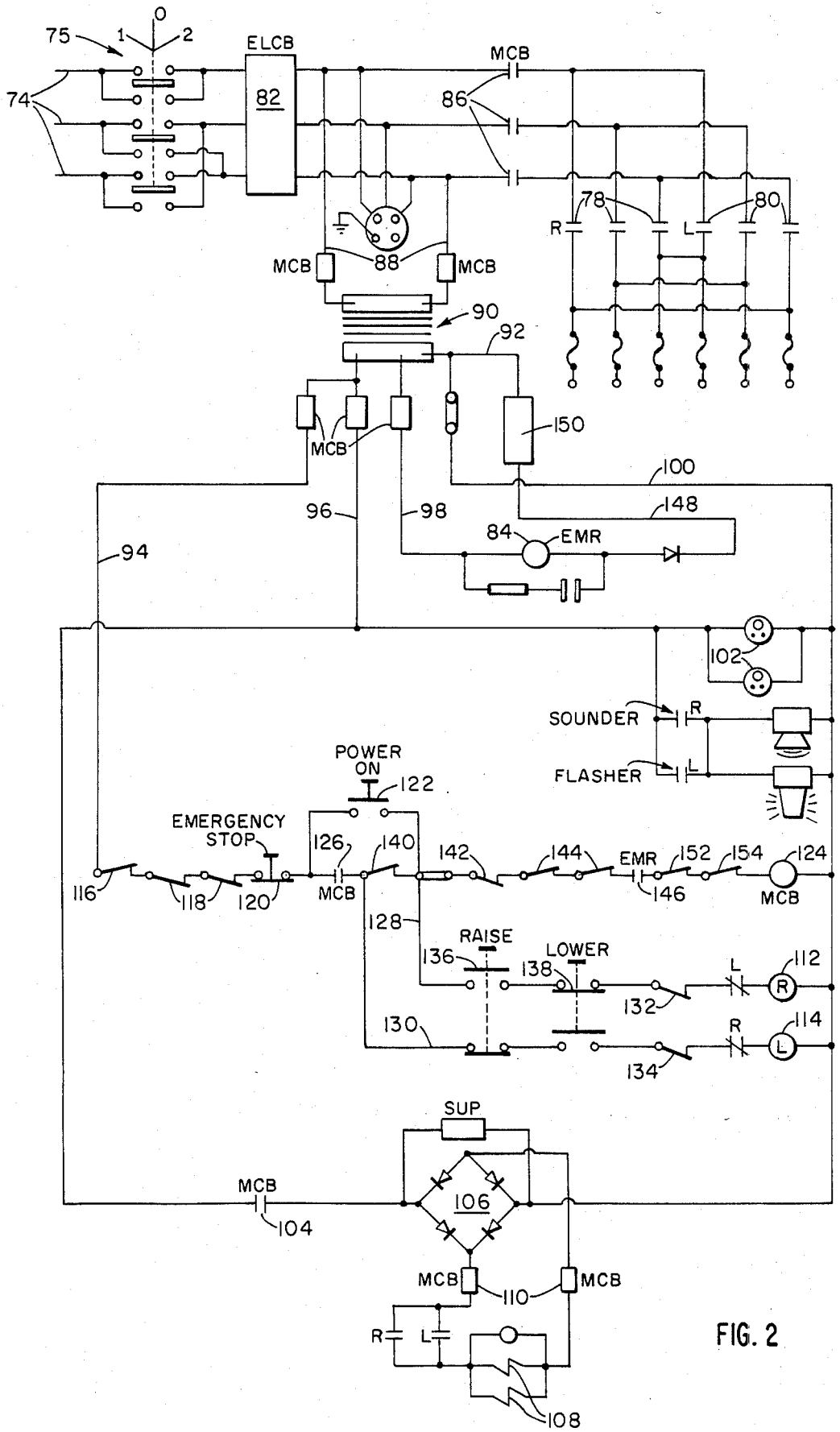
FIG. 2 is a circuit diagram illustrating the supply and control circuitry.

FIG. 2 is a circuit diagram illustrating the electrical supply and control circuitry referred to above. Three phase electrical power is supplied to leads 74 which are connected to a changeover switch 75. The switch 75 may be thrown mechanically to either of two positions for reversing the sequence of the phases to change motor direction in response to closure of contacts 78 of the "raise" button or contacts 80 of the "lower" button on the pendent control, as described above. The switch 75 is connected to contacts in an earth leakage circuit breaker 82 having an operating coil 84. From the circuit breaker 82, three phase leads are connected to contacts of a main circuit breaker 86, from which contacts leads are connected to the contacts 78 and 80, respectively.

Leads 88 from two of the phases are connected to a transformer 90 having 110 volt and 24 volt secondary connections. A lead 92 represents the earth connection to the chassis of the unit as described below. Wires 94 and 96 are at 110 volts above ground, wire 98 is at 24 volts above ground, and a wire 100 is at ground potential.

The wire 96 supplies power to utility outlets 102 on the platform, and connects through contacts 104 on the main circuit breaker 86 to a rectifier 106 for supplying current to the parallel-connected motor brakes 108. Preferably, as shown, current is supplied through other contacts 110 on the main circuit breaker 86.

The lead 94 supplies power for operating a "raise" coil 112 which operates the contactors 78 and a "lower" coil 114 which operates the contacts 80. As will be seen, the current reaches these coils through a number of series-connected contacts that provide essential safety features in accordance with this invention. Contacts 116 are on a limit switch that is located so that the contacts will be closed only when the crane 56 is in its "parking" position as described above. Contacts 118 belong to limit switches located so that the contacts will be closed only when the gates 40 are closed. Contacts 120 are on the "emergency stop and lock" button on the pendent control. These contacts remain open once the button is depressed, and are not reclosed until the button is mechanically rotated and released in accordance with conventional practice.

A "power on" button 122 is of the type that must be held down to make contact. When it is initially depressed, current is supplied to a main contactor coil 124 having locking contacts 126. When the pushbutton 122 is then released, the current is maintained through the contacts 126.

In normal operation, leads 128 and 130 are respectively connected through a normally closed top working limit switch 132 and a normally closed bottom working limit switch 134 in the energizing circuits of the "raise" coil 112 and "lower" coil 114, respectively. A "raise" button 136 completes the circuit to the coil 112 when the limit switch 132 is in its normal closed position with the platform below its top working limit position. Similarly, a "lower" pushbutton 138 completes the circuit for energizing the coil 114 for lowering the platform when the limit switch 134 is in its normal closed position with the platform above its lower working limit position.

Additional safety features are provided by an ultimate lower limit switch 140 and an ultimate top limit switch 142. The switch 140 is normally closed, but opened if the platform has moved beyond the normal opening position of the switch 134, due to a possible failure thereof. Similarly, the switch 142 is normally closed, but opens if the platform is elevated above the position in which the switch 132 normally opens, due to a possible failure thereof. Thus for example, upon operation of the switch 140, the operating coil 124 of the main circuit breaker is deenergized. This opens the contacts 86 leading to the motor leads 78 and 80. On the other hand, if the "power on" button 122 is depressed in the condition with the ultimate lower limit switch 140 open, a circuit is provided to the operating coil 124 as well as to the lead 128, whereby it is possible to raise the platform by depression of the "raise" button 136. The movement of the platform will then automatically reclose the limit switch 140.

On the other hand, the opening of the ultimate top limit switch 142 does not have a similar effect, in that depression of the "power on" button 122 does not supply power to the operating coil 124 of the main circuit breaker and it is not possible to raise or lower the platform.

Contacts 144 are located in the switches 72 shown in FIG. 1. These switches are shown at the two ends of the pull wire 70; however, in the alternative it may be desired to provide rollers at the four corners of the platform, and to wrap the wire 70 around substantially the entire perimeter, in which case the switches 72 are located adjacent the aperture 36, thus providing full perimeter protection by means of these two switches.

Contacts 146 are operated by the coil 84 in the earth monitoring relay. The coil 84 is energized by the 24 volt lead 98 connection to the transformer 90, with the circuit being completed through a lead 148 that descends from the control panel to the chassis represented at 150, through the chassis to the ground lead 92 that extends from the chassis back to the transformer 90. Thus if the circuit is broken by failure of the wire 148 to be connected to the ground lead 92 through the chassis, the coil 84 is deenergized, opening the contacts 146.

Contacts 152 and 154 are overload relay contacts in the respective motors as previously described.

Preferably, a safety fence is erected on the platform surrounding the mast. This has been omitted from the drawing for clarity of illustration.

I claim:

1. Apparatus comprising, in combination, a wheeled chassis having a vertically extending mast section secured thereon, the mast section having a pair of parallel vertical racks secured thereto, a platform having an aperture partially surrounding said mast section and being vertically displaceable thereon, the platform and mast section having mutually cooperative parts comprising a normally closed top working limit switch operable when the platform is elevated to a predetermined position on the mast, a pair of mutually independent drives on the platform each comprising an electrical motor, a reduction gear train driven by the motor and a pinion driven by said gear train and engaging a separate one of said racks, and a control circuit comprising terminals for connection to a source of electrical power, a circuit breaker having contacts connected to each of said terminals, a raise coil and a lower coil each having contactors connecting between the circuit breaker contacts and said motors, said motors being connected in parallel, the contactors of said coils being connected for opposite directions of rotation of the motors, and a coil energizing circuit including a normally energized lead and a pair of circuits extending therefrom to the raise and lower coils respectively, said circuit to the raise coil including said normally closed top working limit switch.

2. Apparatus according to claim 1, in which said circuit to the lower coil includes a normally closed bottom working limit switch operable upon the platform reaching a height within a predetermined distance of the bottom of the mast.

3. Apparatus according to claim 1, in which the circuit breaker has a coil and an energizing circuit therefor connected in parallel with said circuit to the raise coil.

4. Apparatus according to claim 3, in which the energizing circuit for the circuit breaker coil includes a normally closed ultimate top limit switch operable upon the platform reaching a height above the position in which the top working limit switch is operable.

5. Apparatus according to claim 3, in which the circuit breaker coil has contacts for deenergizing said normally energized lead when the last-mentioned coil is deenergized.

6. Apparatus according to claim 5, including a normally closed ultimate bottom limit switch in said normally energized lead and operable upon the platform reaching a height below the position in which the bottom working limit switch is operable.

7. Apparatus according to claim 6, including a power on switch bridging the contacts of the circuit breaker coil and the ultimate bottom limit switch to permit energization of said circuits to the raise coil and circuit breaker coil.

* * * * *